252-99 AU 166 EX
3/21/78 XR 4,080,305

United States Patent [19]
Holdt et al.
[11] 4,080,305
[45] Mar. 21, 1978

[54] DRAIN CLEANERS WITH HAIR-DISINTEGRATING PROPERTIES

[75] Inventors: Berndt-Dieter Holdt, Dusseldorf; Hans Dieter Soldanski, Essen; Günter Wischberg, Erkrath-Unterfeldhaus; Christian Hase, Erkrath-Unterbach; Dieter Kühling, Monheim; Harald Schnegelberger, Leichlingen, all of Germany

[73] Assignee: Henkel Kommanditgesellschaft auf Aktien, Dusseldorf-Holthausen, Germany

[21] Appl. No.: 688,608

[22] Filed: May 21, 1976

[30] Foreign Application Priority Data

May 23, 1975 Germany ..... 2522904
Jan. 26, 1976 Germany ..... 2602740

[51] Int. Cl.[2] ..... C11D 7/54
[52] U.S. Cl. ..... 252/103; 252/95; 252/99; 252/105; 252/156; 252/157
[58] Field of Search ..... 252/156, 94, 95, 89 R, 252/99, 157, 103, 105

[56] References Cited

U.S. PATENT DOCUMENTS

| | | | |
|---|---|---|---|
| 1,129,056 | 2/1915 | Anhaltzer | 252/157 |
| 3,715,184 | 2/1973 | Kuhling | 252/99 |
| 3,775,332 | 11/1973 | Heins et al. | 252/95 |
| 3,919,102 | 11/1975 | Kuhling et al. | 252/99 |
| 3,968,048 | 7/1976 | Bolan | 252/157 X |

FOREIGN PATENT DOCUMENTS

| | | | |
|---|---|---|---|
| 635,942 | 2/1962 | Canada | 252/157 |

*Primary Examiner*—Mayer Weinblatt
*Attorney, Agent, or Firm*—Hammond & Littell

[57] ABSTRACT

Drain-pipe cleaning compositions of the sodium hydroxide — aluminum chip — sodium nitrate type possess the added capability of dissolving or disintegrating proteinaceous fibrous material, without impairment of their capability of removing grease deposits, when they have a small content of a water-soluble glycoluril or a glycoluril derivative.

The compositions are specially useful for freeing drain-pipes which are clogged by fatty deposits containing animal hair.

10 Claims, No Drawings

DRAIN CLEANERS WITH HAIR-DISINTEGRATING PROPERTIES

The invention relates to compositions for freeing drain-pipes which are clogged or stopped with fatty deposits containing animal hair.

Conventional drain-pipe cleaners are solid particulate mixtures based on sodium hydroxide, aluminum chips and sodium nitrate. When added to water, these mixtures generate heat; the heat facilitates removal of solid and semi-solid fatty plugs or deposits and promotes emulsification and saponification of the fat. However, any proteinaceous material present (hair, wool, feathers, etc.) in the clogging fatty composition is at most only slightly affected by the aforesaid cleaners. The action of the aforesaid cleaners is thus almost always incomplete, when hair or similar proteinaceous fiber material has contributed to the clogging.

Certain liquid drain cleaners contain as an active ingredient highly alkaline sodium hypochlorite solutions. These solutions dissolve hair, but their ability to dissolve hair is greatly impaired when the hairs are embedded in the fatty deposits, because these cleaners do not provide the heat which is necessary to render the fatty components of the clogging composition emulsifiable and/or saponifiable.

It is a principal object of the present invention to provide a solid, particulate free flowing composition which, when dissolved in water, will free drain-pipes which are clogged with animal hair, wool or other fibrous proteinaceous material alone or in admixture with solid or semi-solid fatty material.

It is an additional object of the invention to provide a solid composition which will dissolve readily in water and provide a solution which will disperse such fibrous and fatty materials.

It is a further object of the invention to provide such a composition which will release sufficient heat when admixed with water to provide a solution having a temperature at or near the boil and which will possess excellent drain cleaning properties for the purpose described.

The present invention is based on the surprising discovery that the presence of glycoluril

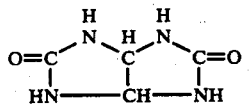

and water-soluble or alkali-soluble derivatives thereof considerably increases the sufficiency of these cleaners in solubilizing fat deposits which contain animal hair or similar fibrous material by providing a fiber-disintegrating or fiber-solubilizing reaction. The heat developed by the solid cleaner as it dissolves is insignificantly influenced by the presence of the glycoluril, so that the action of the cleaner in emulsifying and saponifying the fatty clogging material is hardly affected.

The invention thus relates to drain cleaners with hair-disintegrating action, based on solid mixtures of alkali metal hydroxide of a light metal chips, and an alkali metal or alkaline earth metal nitrate, characterized by a content of 0.5% to 5% by weight of glycoluril or derivatives thereof as a hair-disintegrating component.

More specifically, the present invention provides an improvement in the conventional solid compositions adapted to unclog or clear drain-pipes blocked by deposits of fatty material containing animal hair, said compositions consisting essentially of an alkali metal hydroxide as latent saponifying and heating agent, particles of a normally solid light metal of atomic number 12–13 as latent agent providing hydrogen gas in amount effective to loosen said deposits, and an alkali metal or alkali earth metal nitrate as oxidizing agent for said hydrogen, the improvement being a small but effective amount, in the range of about 0.5% – 5% based on the weight of said compositions, of a water-soluble glycoluril as disintegrating agent for any animal hair present in said fatty deposits. The latent components become active when the composition is dissolved in water.

The components are preferably present in particulate (i.e., powder, granular or pellet) form so that the composition can be readily poured from a can and so that it dissolves readily in water.

The preferred alkali metal hydroxides are sodium and potassium hydroxides; the preferred light metal is aluminum; the preferred metal nitrate is sodium nitrate, and the preferred hair disintegrating agents are glycoluril itself, dichloroglycoluril, and tetraacetylglycoluril.

The principal ingredient of the cleaners of the invention is a solid alkali metal hydroxide, preferably sodium hydroxide. A technical grade sodium hydroxide is suitable and is therefore preferred. The alkali metal hydroxide provides a hot cleaning solution at the point where the clogging deposits are found in the pipe, since it dissolves with considerable generation of heat, thus enhancing the melting or liquefaction of the semi-solid and solid fatty substances present, as well as accelerating their saponification. Secondly, the alkali metal hydroxide has a saponifying effect on the fatty material. The resulting soaps have an emulsifying action and thus facilitate the removal of additional solid and semi-solid fatty material.

The amount of alkali hydroxide in the cleaner is about 50% to 80% by weight.

The second component of the cleaner is a light metal in chip, powder or granulated form. Preferably aluminum chips are used, but magnesium chips are also useful. The solution formed by the dissolution of the alkali metal hydroxide reacts with the metal, forming hydrogen. The evolution of this gas causes bubbling and whirling at the point of the clogging deposit, so that the plug of fatty material is loosened mechanically. The whirling action imparted by the hydrogen gas also accelerates the dissolution of the caustic alkali metal hydroxide, so that the cleaning solution, as it forms, reaches a higher temperature whereby its chemical and physical properties are improved.

The amount of light metal chips in the cleaner is 4% to 10% by weight.

Since the evolution of hydrogen gas can lead to the formation of an explosive or combustible oxygen-hydrogen gas mixture, an alkali metal or alkali earth metal nitrate is used as the third component. Preferably sodium nitrate is used. The reaction of the nitrate with the hydrogen gas produces ammonia gas, which is harmless. This reaction does not impair the above-described whirling effect of the gas stream.

The amount of alkali metal or alkali earth metal nitrate in the cleaner is 15% to 40% by weight.

In order to obtain a hair-disintegrating or hair solubilizing effect, the glycoluril (glycoluril itself or a glycoluril derivative like dichloroglycoluril, tetrachloroglycoluril, tetrapropionylglycoluril, 1,4-diacetylglycoluril, tetraacetylglycoluril, etc. or mixtures thereof) is added to the cleaner as the fourth component. This augments the action of the strong hot caustic solution on the hairs and similar fibers, like wool, to such an extent that these materials are broken up and disintegraing. In general, suitable compounds are selected from the group consisting of the halogenated glycolurils and the glycols which have been acylated with a lower (e.g. $C_1$–$C_4$) alkanoic acid.

The aforementioned glycoluril and derivatives are soluble to the extent of at least 5% by weight in aqueous alkali metal hydroxide solution at temperatures above 40° C.

After the freeing action of the mixture is spent, it is advisable to rinse the pipe with hot water to remove any disintegrated fibers which may remain.

The amount of glycoluril or glycoluril derivatives in the cleaner is 0.5% to 5% by weight. The hair-disintegrating action depends on the alkalinity and temperature of the solution. The solution should be composed of 5 to 20 parts of water per part of the solid components and it should be used before its temperature drops below 40° C. Preferably the solution is used when it is at maximum temperature, in the range 50°–80° C, depending on the amount of water used. A typical example of the composition of a drain cleaner according to the present invention is as follows:

| Component | % By Weight |
|---|---|
| Sodium hydroxide, flakes | 50 - 80 |
| Aluminum, chips | 4 - 10 |
| Sodium nitrate, powder | 15 - 40 |
| Glycoluril or glycoluril derivative, powder | 0.5 - 5 |

In addition, the composition may contain the other materials which are customarily present in drain cleaning compositions of this type, for example, an identifiying dye or pigment, an alkali-resistant perfume, and an alkali-resistant detergent.

The composition is employed in the same manner as conventional drain-pipe cleaners, by adding one part thereof to about 5 to 20 parts of water (preferably warm), pouring the resulting mixture into the drain, and allowing the solution to remain in contact with the obstruction in the drain-pipe until its cleaning action is complete.

The invention is further illustrated by the examples which follow. These examples constitute preferred embodiments of the invention and are not to be construed in limitation thereof.

EXAMPLE 1

The following illustrates the preparation of a drain cleaning composition of the present invention.

Into a laboratory mixer of the tumbler type were placed the following.

| | |
|---|---|
| Sodium hydroxide, flake, tech. | 54 g. |
| Aluminum, chips | 8 |
| Sodium nitrate, powder | 36 |
| Tetraacetylglycoluril, powder | 2 |
| Total | 100 g. |

The mixture was tumbled briefly. A homogeneous, dry, free-flowing particulate composition was obtained.

EXAMPLE 2

A. Into a 1-liter beaker was placed 1 g. of long animal hairs, and a lead cuff was placed over the ends of these hairs to hold them in place.

To the beaker was added 500 ml. of water at 20° C., after which 50 g. of the composition of Example 1 was added with stirring. The composition dissolved very rapidly and a large amount of heat developed.

After about one minute the temperature of the contents of the beaker reached about 79° C., which was the maximum. After a total reaction time of 20 minutes, the lead cuff was removed and the contents of the beaker were emptied on a screen having 2 mm. apertures. The screen was rinsed with a medium force water jet. No residues remained on the screen, but a few hair residues were attached to the underside of the lead cuff where the solution had not reached showing that solubilization of the hair was complete.

B. A control test was made with in the same manner as run (A), but without tetracetylglycoluril. The temperature reached by the mixture after about one minute was 82° C. (the maximum). After a total reaction time of 20 minutes, the lead cuff was removed and the contents of the beaker were again emptied on the screen and the surface of the screen was rinsed with a water jet as before. Practically the entire amount of hair used remained on the screen.

EXAMPLE 3

The procedure of Example 2 (A) was repeated except that the tetraacetylglycoluril was replaced by dichloroglycoluril. The solution showed a substantially the same good hair-disintegrating action.

We claim:

1. A composition adapted to unclog drain-pipes blocked by deposits of fatty material contains fibrous proteinaceous material consisting essentially of 50% to 80% by weight of an alkali metal hydroxide as latent saponifying and heating agent, 4% to 10% by weight of particles of a light metal of atomic number 12–13 as latent agent providing hydrogen gas in amount effective to loosen said deposits 15% to 40% by weight of an alkali metal or alkali earth metal nitrate as latent oxidizing agent for said hydrogen, and a small but effective amount, in the range of about 0.5% - 5% based on the weight of said composition, of a compound selected from the group consisting of glycoluril, halogenated glycolurils, glycolurils acylated with lower alkanoic acids and mixtures thereof as disintegrating agent for said animal hair.

2. A composition according to claim 1 wherein said compound is selected from the group consisting of glycoluril, dichloroglycoluril, 1,4-diacetylglycoluril, 1,4-dipropionylglycoluril, tetraacetylglycoluril, tetrapropionylglycoluril, and tetrachloroglycoluril.

3. A composition according to claim 1 wherein said compound is glycoluril itself.

4. A composition according to claim 1 wherein said compound is tetraacetylglycoluril.

5. A composition according to claim 1 wherein said compound is dichloroglycoluril.

6. A composition according to claim 1 wherein said compound is 1,4-dipropionylglycoluril.

7. A composition for cleaning drains clogged with a fatty mixture containing animal hairs consisting essentially of:

| Components | % By Weight |
|---|---|
| Sodium hydroxide | 50–80 |
| Aluminum chips | 4 – 10 |
| Sodium nitrate | 15 – 40 |
| A compound selected from the group consisting of glycoluril, halogenated glycolurils, and glycolurils acylated with acyls of lower alkanoic acids | 0.5 – 5 |

8. A composition according to claim 7 wherein the compound is glycoluril itself.

9. A composition according to claim 7 wherein the compound is tetraacetylglycoluril.

10. A method for cleaning a drain blocked by a plug of fatty material containing fibrous proteinaceous material, which comprises mixing one part of a composition according to claim 1 with about 5 to 20 parts by weight of water, and then pouring the resulting mixture into said drain at a temperature in the range of 50° C. to 80° C.

* * * * *